United States Patent [19]

Kindler

[11] Patent Number: 4,887,695

[45] Date of Patent: Dec. 19, 1989

[54] POSITION CONTROL METHOD AND APPARATUS FOR AN ELEVATOR DRIVE

[75] Inventor: Gerhard Kindler, Meggen, Switzerland

[73] Assignee: Inventio AG, Switzerland

[21] Appl. No.: 275,005

[22] Filed: Nov. 22, 1988

[30] Foreign Application Priority Data

Nov. 27, 1987 [CH] Switzerland ..... 04647/87

[51] Int. Cl.[4] ..... B66B 1/30

[52] U.S. Cl. ..... 187/116; 187/118

[58] Field of Search ..... 187/112, 113, 116, 117, 187/118

[56] References Cited

U.S. PATENT DOCUMENTS

| | | | |
|---|---|---|---|
| 4,161,235 | 7/1979 | Caputo et al. | 187/116 |
| 4,470,482 | 9/1984 | Husson | 187/118 |
| 4,629,034 | 12/1986 | Inaba et al. | 187/116 |
| 4,751,984 | 6/1988 | Williams et al. | 187/116 |
| 4,817,761 | 4/1989 | Iwata et al. | 187/116 |

FOREIGN PATENT DOCUMENTS 3001778 7/1981 Fed. Rep. of Germany .

*Primary Examiner*—Todd E. Deboer
*Assistant Examiner*—W. E. Duncanson, Jr.
*Attorney, Agent, or Firm*—Marshall & Melhorn

[57] ABSTRACT

A method and an apparatus for improving the command performance of distance controlled positioning drives, as well as the positioning performance in the region of the destination, responds to different interferences, such as changing load and friction conditions, which act from travel to travel on the positioning drive. A distance control is periodically optimized to a constant set of standardized operating parameters and the position errors caused by interferences are eliminated during every travel. The control is a cascade control with fourfold forward correction by direct bias of the generated desired values of the jerk, the acceleration, and the velocity. A distinction is made between predictable deterministic interferences and not predictable stochastic interferences. Deterministic interferences are detected quantitatively by a start up test during the first phase of jerk in a measuring means. A compensation signal is in a function generator which completely compensates the corresponding position error until the end of the travel. Stochastic position errors are equalized in an integrating amplifier until the end of the travel. For a range of destinations, the remaining residual distance control error is increased for a short time in a distance control error multiplier.

18 Claims, 4 Drawing Sheets

POSITION CONTROL METHOD AND APPARATUS FOR AN ELEVATOR DRIVE

BACKGROUND OF THE INVENTION

The invention relates in general to a method and an apparatus for the control of a positioning drive and, in particular, to such control in an elevator installation.

The typical positioning drive has a cascade structure in which the biasing of an appropriate jerk pattern and a threefold integration over time of the same generates the desired distance value $S_S$, as well as the desired velocity and acceleration values $V_S$ and $B_S$ respectively. When utilized with an electric motor, the velocity and acceleration values are applied directly to the velocity and armature current control circuits respectively for the control of the object to be positioned. Such controls improve the dynamic behavior of the positioning drive so that the actual travel curve better follows the specified optimum desired travel curve. The drive can then be brought up to speed optimally, that is under control, and the best possible utilization of the conditions defined by the desired travel curves can be made in order to reach a predetermined position.

Every positioning drive used in a control system must move to any desired position while maintaining specified conditions. Sometimes, the conditions require that the tolerance ranges for the positioning accuracy and the running-in velocity for the destination position are very narrow, or that the destination position must not be overshot. Frequently however, the positioning process has to be concluded in the minimum possible time, where limit values for jerk, acceleration, deceleration and velocity specific to the installation have to be maintained. Furthermore, there may be a requirement for minimum lost energy. In all these cases, however, the major factor in determining the accuracy and speed of positioning is the regulating or control device and the desired travel curve acting on it as a command variable.

A method and a device for the control of a positioning drive are shown in the German Pat. application 3 001 788, wherein a variable command generator generates the desired travel curve which acts on a cascade control. In the command generator, command values are formed for the desired position value by a threefold integration over time of the predetermined jerk values. The acceleration, that is the integral over time of the jerk, is generated by a starting controller which is limited to the maximum jerk. The desired value of the acceleration is varied at small displacement distances dependent on the remaining distance and at larger displacement distances dependent on the velocity. The desired values generated for distance, velocity, and acceleration are entered as bias values to the cascade control, where the desired values of velocity and acceleration are input directly to the velocity and armature current controllers respectively.

Since, according to the above described method of control, the desired value of acceleration at short displacement distances is dependent on the remaining distance, the problem of the precise determination of the remaining distance is present. The remaining distance is determined not only at the beginning of each short displacement distance, but also is determined continuously as the difference between the actual position of the destination and the desired distance value as determined by the command generator. This determination of the remaining distance assumes, therefore, that the actual value of the distance follows the occasional changes of the desired distance value with minimal lag error. If this is not assured, the generated travel curves will not be optimal, due to the inaccuracy inherent in them, so that the end portion of the travel distance has to be travelled at a creeping velocity in order that generated control mistakes can be equalized. In order to form an optimal travel curve, a good response behavior of the cascade control is essential.

In the case that the optimum desired travel curves, calculated from imputed data and provided destinations by known travel curve computers, are available, there results an optimal travel only if the actual value of distance is able to follow the desired value of distance at all times. Thus, the control device must exhibit a minimum distance control error. It has been found that subordinated velocity and armature current control circuits, as well as their forward correction by appropriate velocity and acceleration values, as shown in German patent appliction 3 001 718, are often insufficient to guarantee the accuracy of guidance which is necessary in high-grade positioning installations which require, for example, high stopping accuracy. This is particularly due to the frequently important load changes which, from travel to travel, can act as disturbances in a positioning installation. Thus, a further drawback is created in that such regulated drives frequently have to be oversized in order to be able to precisely follow the desired distance value even in the most unfavorable case of loading. Obviously, the economy of such devices is thereby impaired. The present invention provides a remedy for such problems and deficiencies.

SUMMARY OF THE INVENTION

Accordingly, it is the purpose of the present invention to provide a method and a device to assure an improved command behavior in distance controlled positioning drives, so that the actual distance value can follow the desired distance value with high precision. Such high command accuracy is assured even in the case where various outside influences act on the positioning drive from travel to travel or, if in the region of a point of destination, after a stop, a distance correction must be performed.

The problems and deficiencies of the prior art drives are solved, according to the present invention, by a means and a method which provide the following advantages for positioning drives:

A first advantage results from using command variables created from multiple integrations such that no additional errors are generated. However, this would also be the case to a great degree if the intermediate command variable were formed by multiple differentiation of the desired distance value as an alternative.

A further advantage is that all controlled system elements follow the given command variables very precisely and almost without delay.

It has also been found that the command behavior of the control is largely independent of the amplification factors of the controllers and of parameter value changes of the control path which is another advantage.

The present invention provides a method and an apparatus for periodically optimizing to a constant set of standardized operating parameters and eliminating during every trip the position errors caused by interferences such as changing load and friction conditions. A cascade control is fourfold forward corrected by direct bias of the generated desired values of jerk, acceleration, and velocity. A distinction is made between predictable deterministic interferences and unpredictable stochastic interferences. Deterministic interferences are detected quantitatively by a start up test during the first phase of jerk and a compensation signal is formed which completely compensates the corresponding position error until the end of travel. Stochastic interferences are equalized in an integrating amplifier until the end of travel.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
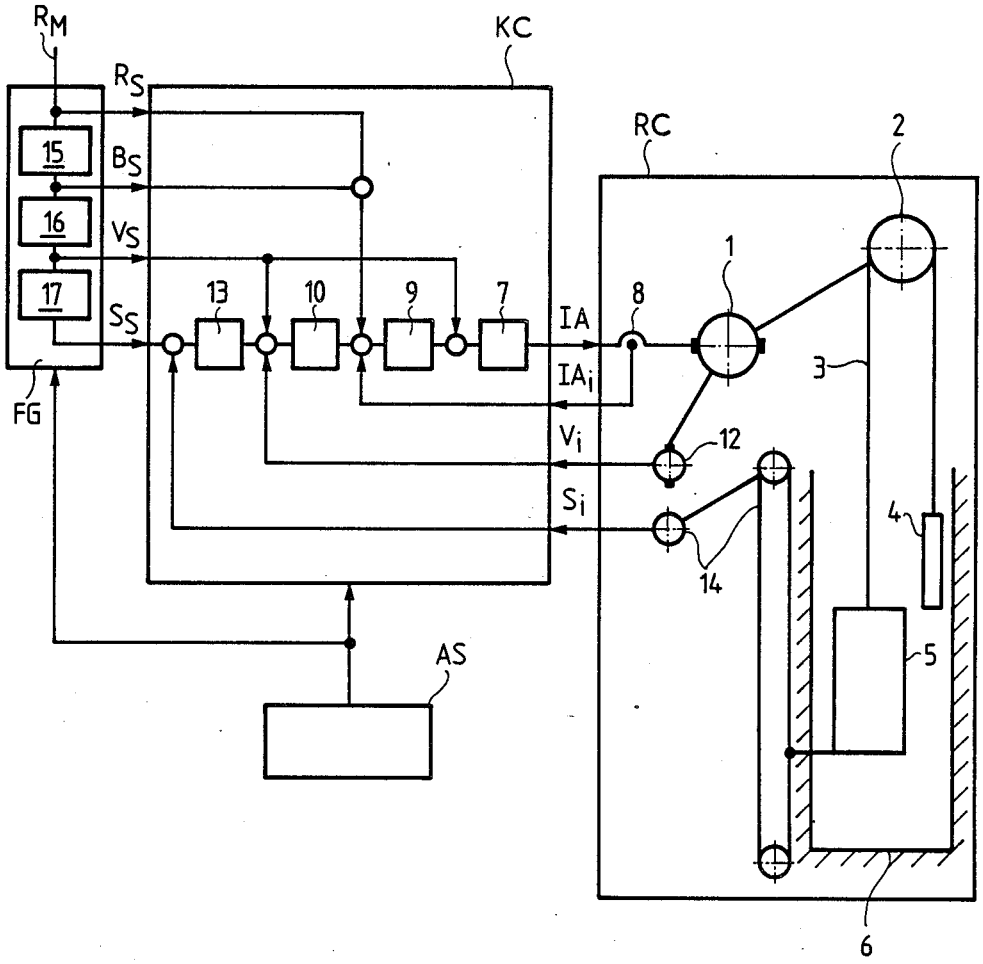
FIG. 1 is a schematic block diagram of a distance controlled positioning drive according to the present invention utilized in an elevator installation.

A controlled positioning drive according to the present invention is shown in FIG. 1. The drive includes a cascade control KC and a series connected control path or controlled element RC shown as an elevator drive. The desired values of the selected control variables are generated by a variable command generator FG to the cascade control KC as desired command signals $R_S$ (jerk), $B_S$ (acceleration), $V_S$ (velocity), and $S_S$ (distance). The cascade control KC will be explained in more detail below in connection with FIG. 2.

The controlled element RC comprises an elevator including an electric motor 1 coupled to a drive sheave or pulley 2 over which a drive cable 3 extends. The drive cable 3 is connected between a counterweight 4 and a car 5 for travel in an elevator shaft 6. Electric power represented by armature current IA is supplied to the electric motor 1 by a control unit 7 in the cascade control KC. The magnitude of the current IA is sensed and fed back as an actual armature current signal $IA_i$ by a current transformer 8 connected in series in the armature current circuit. The transformer 8 is connected between the output of the control unit 7 and the motor 1. The actual armature current signal $IA_i$ is an input to a current controller cascaded with the control unit 7. In similar manner, a velocity controller 10 is superimposed on or cascaded with the current controller 9, which velocity controller receives an actual velocity signal $V_i$ generated by a tachometer generator 12 coupled to the electric motor 1 and representing the velocity of travel of the car 5 in the elevator shaft 6. Furthermore, a distance controller 13 is cascaded with the velocity controller 10, and receives an actual distance signal $S_i$ from a distance signal generator 14 driven by the car 5. The command signals $V_S$, $B_S$ and $R_S$ are directly input as correcting values to the underlying control circuits as well as to the control unit 7 as forward or input corrections. The operation of the underlying control circuits, as well as their forward correction through direct bias of the corresponding command variables, constitutes an efficient aid for the improvement of the dynamic performance of controlled systems.

Desired distance values are formed in the variable command generator FG by a threefold integration over time of a jerk input value $R_M$ by means of integrators 15, 16 and 17. The desired distance value is generated to a first summing point in the cascade control KC as the desired distance signal $S_S$. The first summing point also receives the actual distance signal $S_i$ and generates the difference between the signals at an output connected an input of the distance controller 13. Desired values of velocity and acceleration are generated as intermediate values of this threefold integration over time. These values, together with the jerk input value $R_M$ forming their basis, are inputted as forward corrections to the cascade control. For example, the desired velocity signal $V_S$ is inputted at a second summing point connected between an output of the distance controller 13 and an input of the velocity controller 10. The second summing point also receives the actual velocity signal $V_i$ and adds the difference between the signals to the distance controller output. The desired acceleration signal $B_S$ and the desired jerk signal $R_S$ are generated to a third summing point in the cascade control KC. The third summing point generates the sum of the two signals to a fourth summing point which is connected between an output of the velocity controller 10 and an input of the current controller 9. The fourth summing point also receives the actual armature current signal $IA_i$ and adds the difference between the two signals to the velocity controller output. Finally, the desired velocity signal $V_S$ is added to the current controller output at a fifth summing point connected between the current controller 9 and the control unit 7. The function processes in the control KC are coordinated by a run or operating control AS.

Figure 2:
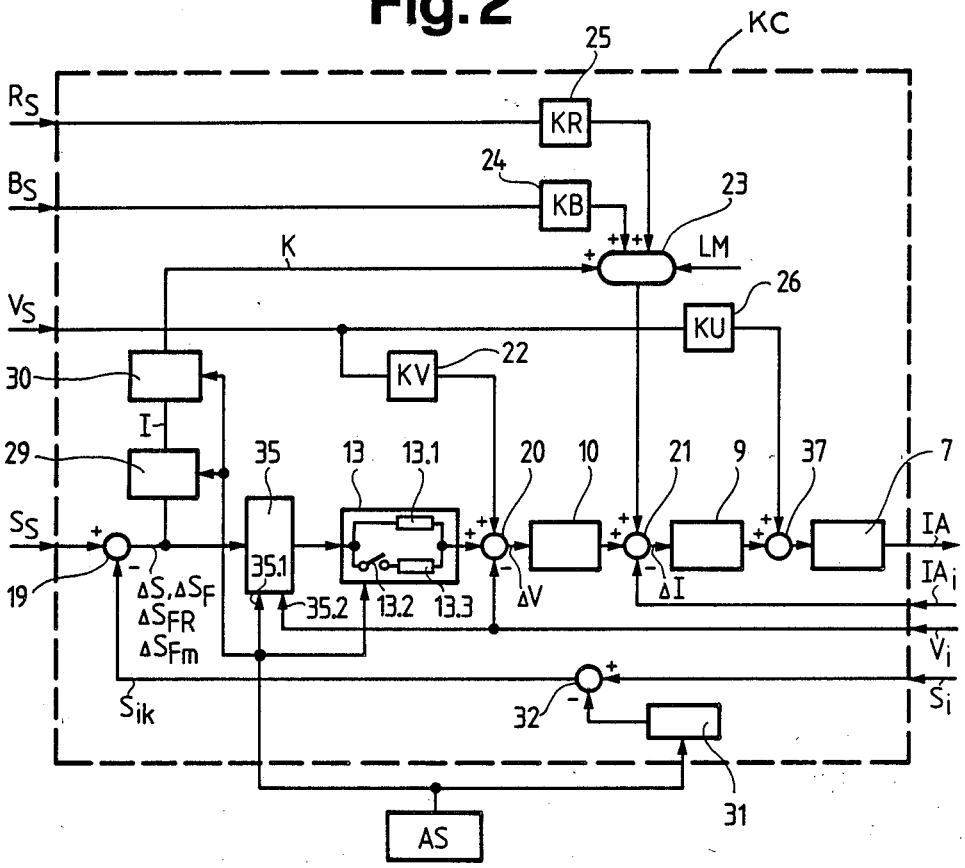
FIG. 2 is a schematic block diagram of a cascade control according to the invention as shown in FIG. 1.

FIG. 2 shows a schematic block diagram of the cascade control KC in greater detail. The methods and the device of the present invention provide for the optimization and command performance of the positioning control with respect to a standard control distance SR through a fourfold forward correction of the cascade control KC. For the standardization of the control distance, its parameters ($P_1$, $P_2$...$P_n$) are based on a standardized set of values ($W_1$, $W_2$...$W_n$). Located outermost in the cascade structure is a distance control circuit including the first summing point, shown as a distance comparator 19, and the distance controller 13. The distance controller 13 includes a proportional amplifier 13.1 to which a series connected switch 13.2 and integrating amplifier 13.3 are connected in parallel. Subordinated to the distance control circuit is a velocity control circuit including the second summing point, shown as a velocity comparator 20, and the velocity controller 10. A current control circuit including the fourth summing point, shown as a current comparator 21, and the current controller 9 is the next stage in the control KC. The control unit 7 can be designed as a static or a rotary converter or consist of a subordinated voltage control circuit.

The cascade control KC is forward-corrected, that is the generated desired values $V_S$, $B_S$ and $R_S$ are preset directly to the inputs of the two subordinated control circuits and the control unit 7 with applicable scale factors. Thus, the desired velocity signal $V_S$ is generated to the input of the velocity controller 10 through a first velocity correction element 22 as well as to the input of the control unit 7 through a second velocity correction element 26. The desired acceleration value $B_S$, together with the desired jerk value $R_S$, are generated to the input of the current controller 9 through an acceleration correction element 24 and a jerk correction element 25 respectively. Assigned to the correction elements 22, 24, 25, and 26 are the scale factors KV, KB, KR, and KU respectively. As a consequence, each control circuit receives directly, without delay and precisely, the associated command variabls generated by the variable command generator FG. Thus, the output variable no longer has to be equal to the resetting variable of the associated actual value signal in order to stabilize the control error of the subordinated control circuit back to zero.

Next, the elimination of the distance control errors $\Delta S_F$, result from the deterministic and stochastic interferences acting on the standard control distance SR, are considered. One type of distance control errors $\Delta S_{FD}$, originating from deterministic interferences, are generated at an input to a measuring means 29 which forms and stores an appropriate measurement value. Thus, distance control errors which are self compensating for a trip, for instance as a consequence of the dynamic cable extension, are calculated in a computing unit 31 and subtracted from the actual distance signal $S_i$ in a difference amplifier 32. The amplifier 32 generates a self compensated actual distance signal $S_{ik}$ which is subtracted from the desired distance signal $S_S$ at the distance comparator to obtain a distance difference signal $\Delta S$.

In a preferred embodiment of the invention, the measurement means 29 is an integrator which, in the starting phase of each trip, is activated for a certain time period by the operating control AS. Furthermore, the measurement value error signals I determined and stored by the measurement means 29 serve as input variables for a function generator 30. An output compensation signal K of the function generator 30 is connected to the third summing point 23 which is connected to the current comparator 21 at the input of the current controller 9. Distance control errors $\Delta S_{FS}$, caused by stochastic interferences, are generated by a distance control error multiplier 35 to the integrating amplifier 13.3, which can be switched on by the switch 13.2. The switching means for a rapid restart after a stop includes the distance control error multiplier 35 connected between the distance comparator 19 and the distance controller 13 The multiplier 35 has a multiplication factor "m" which, for the restart, can be controlled by the operating control AS connected to an input 35.1 and by the actual velocity signal $V_i$ from the tachometer generator 12 serving as motion detector and connected to an input 35.2. The operating control AS controls "m" before the start of the motion to a value greater than one, and the tachometer generator 12 controls "m" at the start of the motion back to the value one.

Figure 5:
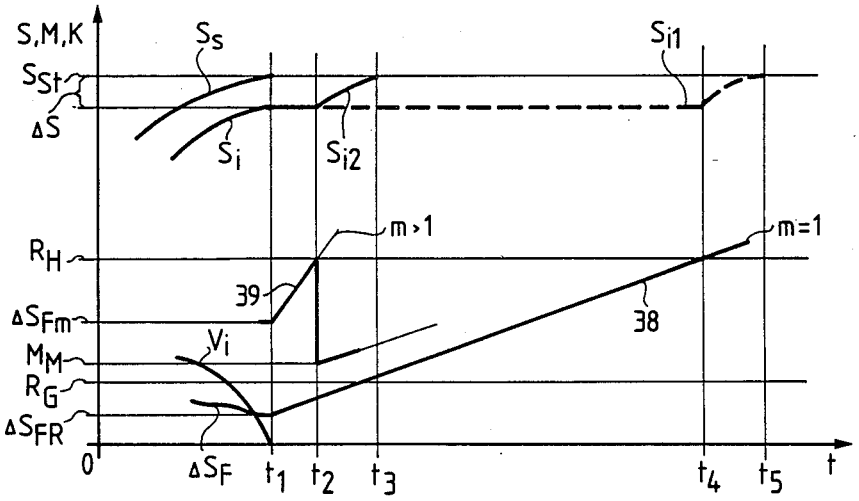
FIG. 5 is a signal magnitude versus time diagram of the conditions in the cascade control of FIG. 1 at a rapid restart after a stop.
Figure 3A:
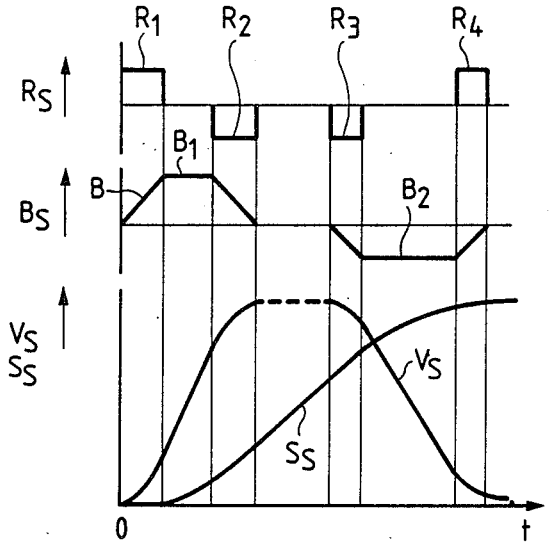
FIG. 3*a* is a signal magnitude versus time diagram of the distance, velocity, acceleration and jerk conditions during the optimization of the command performance of the cascade control of FIG. 2.
Figure 3B:
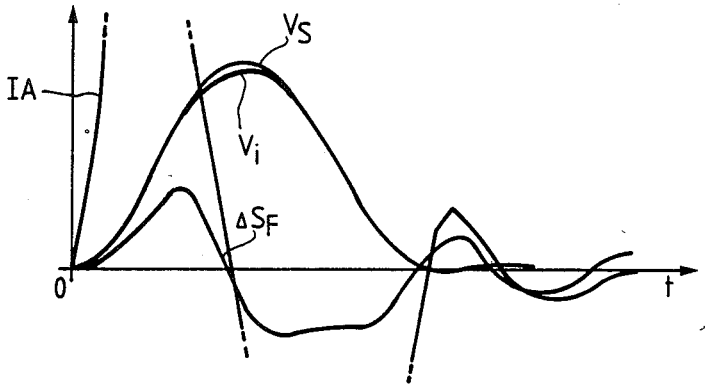
FIG. 3*b* is a diagram similar to FIG. 3*a* showing the travel curves for a not yet optimized command generation during forward correction by velocity and acceleration only.
Figure 3C:
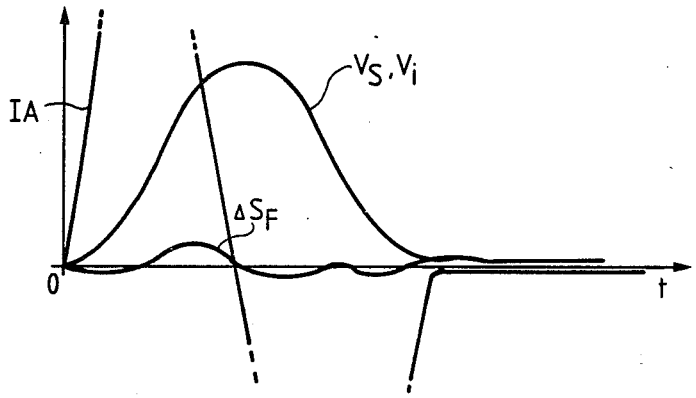
FIG. 3*c* is a diagram similar to FIG. 3*a* showing the travel curves for an optimum command performance during forward correction by a first velocity scale factor, acceleration, jerk and a second velocity scale factor.

FIGS. 3, 4 and 5 show diagrams which clarify the character and function of the control device according to the present invention. From these diagrams it is evident that the command performance of a positioning control is improved in three ways, that is: by fourfold forward correction of the cascade control KC (FIG. 3), by elimination of the distance control errors $\Delta S_F$ (FIG. 4) caused by interferences, as well as by rapid restart after a stop (FIG. 5). FIG. 3*a* shows the desired travel curves as they are generated from each other through integration and serve for the forward correction of the cascade control KC. The travel curves are plotted as magnitude versus time "t" for the generated desired jerk value $R_S$, the generated desired acceleration value $B_S$, the generated desired velocity $V_S$, as well as the generated desired distance value $S_S$. Clearly recognizable are the phases of constant jerk $R_1$, $R_2$, $R_3$, $R_4$ and the phases of constant acceleration $B_1$, $B_2$. The FIGS. 3*b* and 3*c* show the actual travel curves for the armature current IA, corresponding to the earlier mentioned nominal travel curves, the velocity $V_i$ and the distance control error $\Delta S_F$. FIG. 3*b* shows the forward correction by velocity and acceleration, and FIG. 3*c* shows in addition the forward correction of the armature current controller 9 by the generated desired jerk value $R_S$ and of the control element 7 by the generated desired velocity value $V_S$ inputted at the fifth summing point 37.

Figure 4A:
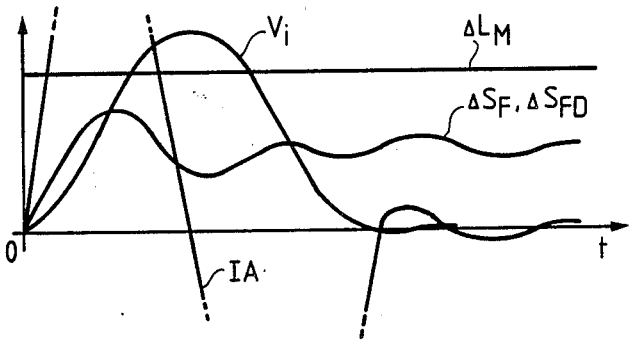
FIG. 4*a* is signal magnitude versus time diagram of the conditions in the cascade control of FIG. 1 during the elimination of disturbing influences on the command performance of the cascade control, showing the travel curves for a deterministic disturbing influence (load measurement error) and for stochastic disturbing influences.
Figure 4B:
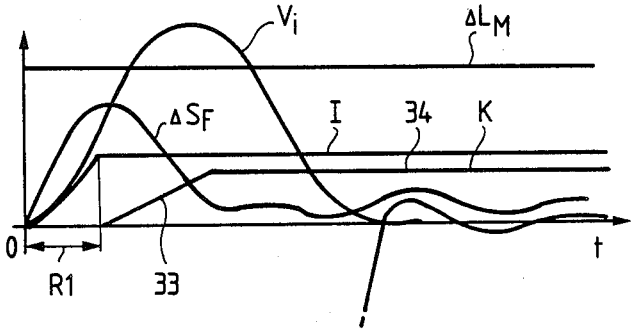
FIG. 4*b* is a diagram similar to FIG. 4*a*, but with compensation of the deterministic disturbing influence.
Figure 4C:
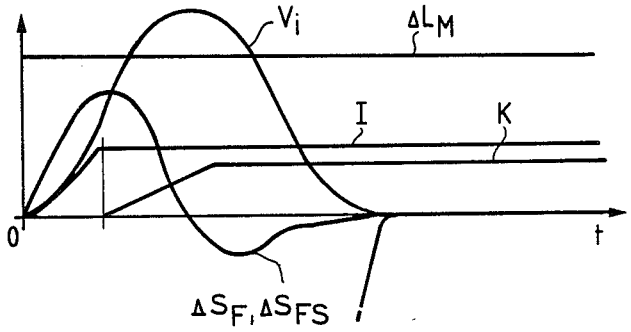
FIG. 4*c* is a diagram similar to FIG. 4*a*, but with simultaneous compensation of the deterministic disturbing influence and decontrol of the stochastic disturbing influences.

Interference influences are the basis for the diagrams shown in the FIGS. 4*a*, 4*b* and 4*c*, that is a deterministic interference in the form of a load measurement error $\Delta L_M$ as well as stochastic interferences which are not illustrated. The distance control error $\Delta S_F$, such as the deterministic distance control error $\Delta S_{FD}$ caused by the interference, comes fully into play in FIG. 4*a* and builds up, slightly damped, to about sixty distance units at the destination point. The deterministic load measurement error $\Delta L_M$ is compensated from the end of the first jerk phase $R_1$ (FIG. 4*b*) by the compensation signal K from the function generator 30. As a start-up test for this, the distance control error $\Delta S_F$ is integrated up to the value of the measurement value error signal I during the first jerk phase and the corresponding compensation signal K assigned to the latter in the function generator 30. The compensation signal K consists of a ramp shaped rise 33 and a constant section 34. By this compensation, the distance control error $\Delta S_F$ becomes stabilized toward the destination point, even if not completely reduced. After termination of the first jerk phase $R_1$, the integrating amplifier 13.3 is connected which stabilizes all remaining distance control errors $\Delta S_F$, in particular the stochastic distance control errors $\Delta S_{FS}$, as shown in FIG. 4*c*. As a consequence of both measures, that is compensation and stabilization, the distance control error $\Delta S_F$ caused by interference is completely eliminated at the destination point.

It is evident from FIG. 5 how the restart can be accelerated if, in spite of the above cited measures, the car, for example due to a remaining distance control error $\Delta S_{FR}$ at a time $t_1$, should come to a halt at a floor. Designated with $R_G$ and $R_H$ are the coefficients of sliding and static friction respectively which are of importance during the restart. From the relatively small $\Delta S_{FR}$, as well as the small adjusting velocity of the distance controller 13, there results a flat rise of the motor torque corresponding to a linearly assumed diagram 38. Thus, the restart, after reaching the static friction $R_H$, can only take place at the time $t_4$ and the floor is only reached at the time $t_5$. The corresponding actual distance travel curve $S_{il}$ follows the desired distance travel curve $S_S$ greatly delayed, with the delay $t_5-t_1$. An actual distance travel curve $S_i$, following the desired distance travel curve more closely, is designated with $S_{i2}$. For this operation, the multiplying factor "m" in the distance control error multiplier 35 is set to a value greater than one at the time $t_1$. Thereby a rise of the armature current IA takes place and the motor torque becomes greater as shown by the linear diagram 39, so that after exceeding the static friction $R_H$, motion occurs at the time $t_2$ and the floor is reached at the time $t_3$. Also at a restart, the actual distance travel curve $S_{i2}$ follows relatively well the desired distance travel curve $S_S$ with a delay of only $t_3-t_1$.

For an explanation of the mode of functioning of the positioning drive, reference is made to FIGS. 1 to 5 and to the steps of the method on which the invention is based. It is assumed that the innovation according to the present invention serves for the operation of an elevator installation, in which a car can travel in a customary manner between floors. The function of the control device consists in varying the position of the car according to a distance-time function generated by the variable command generator FG. No essential control deviations (errors or position) must result from the variation over time of the desired distance signal $S_S$ with respect to the actual distance signal $S_i$ even if the operating conditions, such as the car load, are changing from travel to travel. Functionally this is achieved by a three-step cycle: optimization of the command performance of the cascade control KC with respect to a standardized set of values $W_1, W_2 \ldots W_n$ of the elevator parameters $P_1, P_2, \ldots P_n$; elimination of distance control errors $\Delta S_F$; and acceleration of the restart after a stop.

In order to improve the command performance of the control, the latter is designed according to the above cited first two method steps as the cascade control KC shown in the drawings and adjusted to a standardized set of values $W_1, W_2 \ldots W_n$ of the elevator parameters $P_1, P_2 \ldots P_n$. The choice of the standardized set of values $W_1, W_2 \ldots W_n$ is in itself arbitrary, but it is advantageous to choose it in such a way that it corresponds to the average operating conditions to be expected in the course of normal elevator operation. These are therefore specified as follows: Car load equal to one half rated load, load balancing by counterweight equal to one half rated load, and full compensation of an eventual imbalance as well as of the sliding friction. An elevator operated in this manner by the cascade control KC moves a control distance which is based on standardized operating conditions and is regarded therefore in the following as the standard control distance SR.

The control of this standard control distance SR by a prior art cascade control would lead to distance control errors $\Delta S_F$, which in essence would be determined by the amplification of the distance controller 13, by the amplification of the subordinated control circuits, as well as by the dynamic performance of the control distance. Such control errors $\Delta S_F$ cannot be sufficiently reduced by so-called disturbance variable modulation in the configuration according to FIG. 2, because the sluggish and slightly damped mechanical elevator system permits only very slow corrections in the distance control circuit. As a consequence of these errors, there would result either a creeping into the floor of destination or, after overtravelling the destination, a delayed travel direction reversal with a following creeping travel.

According to the present invention, the cascade control KC is therefore optimized in its command performance by fourfold forward correction on the standard control distance SR. By appropriate choice of the scale factors KV, KB, KR and KU, which are calculated from the parameters of the standard control distance SR, it is possible to reduce the earlier mentioned distance control errors $\Delta S_F$, resulting from the change in time of the nominal distance value $S_S$, to a great extent. For this, the scale factors KV, KB, KR, and KU, shown in FIG. 2, are adjusted in such a way that in each case the ideal desired value results from the subordinated control circuit from the product of command value times the scale factor. Only simultaneous bias of $V_S$, $B_S$ and $R_S$ can sufficiently reduce the control errors in the sub-loops. Of special importance is the jerk bias according to the invention which offers improvements by the fact that delays caused by the sluggishness of the current control circuits are reduced precisely at the moment when the variable command generator FG demands instantaneous changes. The control unit 7 is thereby able to convert the specified operating sequences into actual car movements.

Illustrated in the following is an example of a direct current drive. Since the EMF (electromotive force) in motors which are not field-weakened is proportional to the elevator velocity to a great extent, the necessary armature voltage for the desired velocity can be directly supplied by means of $V_S$ and the scale factors KV and KU to the hoisting motor through the controlling unit 7 and a subordinated voltage control circuit respectively. In order to be able to vary the armature current sufficiently rapidly each time at the beginning and end of a jerk phase, the output voltage of the regulating unit is influenced by means of $R_S$ and the scale factor KR through the current controller 9. This is obviously also applicable in the case of a subordinated voltage control circuit. In the case of field-weakened drives, the scale factors KR, KV and KU have to be adjusted according to the weakening of the field.

With the earlier described forward correction of the cascade control KC, its command performance with respect to a standardized set of values is optimized for the elevator parameters, so that according to FIG. 3c, the distance control errors $\Delta S_F$ caused by rapid changes of the command variables are reduced to a great extent. However, in the operation of an elevator installation it is not possible to start out from an invariable set of values for the elevator parameters, since in general different operating conditions exist from travel to travel which change at least some of the elevator parameters. For example, parameters which can change include the load value and thus also the mass, the position of the load, the sliding friction and in general the data of the spring-mass-system represented by an elevator. All these parameter value changes, $\Delta W_1$, $\Delta W_2$. . . $\Delta W_n$ referred to the standardized parameter values are designated in the following as interference. As a consequence of these, the coordination between the cascade control KC and the elevator drive RC, achieved by fourfold forward correction, is no longer an optimum, which leads to new distance control errors $\Delta S_F$.

The next step, therefore, is to eliminate these distance control errors $\Delta S_F$, which are caused by interferences and are different from travel to travel, by three additional method steps according to the invention. It is known that the essential control-technological disturbances acting on the elevator installation are deterministic in such a sense that they can be detected by a starting test and remain constant for the duration of a travel. The remaining, less important disturbances are stochastic in the sense that they cannot be determined by a starting test and that they can change accidentally during the duration of a travel. Distance control errors $\Delta S_{FD}$ caused by deterministic disturbances are therefore predictable, so that a corresponding change in the cascade control KC can be freely programmed without feedback. The fourfold forward corrected cascade control KC, according to the present invention, is therefore also designed as a parameter-adaptive control system which from travel to travel is matched automatically to the deterministic parameter value changes.

For the elimination of interference caused distance control errors $\Delta S_F$, the deterministic distance control errors $\Delta S_{FD}$ are now compensated according to the invention by a compensation signal K and the stochastic distance control errors $\Delta S_{FS}$ equalized by the integrating amplifier 13.3 in the distance controller 13. This method for the suppression of interferences is graphically presented in the FIGS. 4a, 4b and 4c. A load measurement error $\Delta L_M$ of minus twenty per cent desired load is assumed in FIG. 4a as a deterministic interference which results in a corresponding distance control error $\Delta S_{FD}$. The car comes to a stop about sixty distance units, that is about thirty millimeters, ahead of its destination because about sixty distance units are required to compensate the assumed load measurement error $\Delta L_M$ of sixty-five Amperes.

FIG. 4b shows the compensation of this deterministic load measurement error during the first jerk phase $R_1$ as the distance control error $\Delta S_{FD}$ is integrated over time in the measuring means 29. This integral is designated by I and is a measure for the assumed load measurement error $\Delta L_M$ respectively in the general case for all existing deterministic interferences. A gently rising compensation signal K with a ramp-shaped rise 33 and a constant magnitude portion 34 is now formed in the function generator 30 and made to act on the current controller 9, so that the distance control error $\Delta SE_D$ obtained across the remaining travel distance is completely compensated. The connection between I and the amplitude of K is mathematically or empirically deductible and stored as a function in the function generator 30. The ramp 33 can be formed with either a variable slope with a constant rise time or a variable rise time with a constant slope.

As a result of this compensation K, the remaining distance control error $\Delta S_{FR}$ is small at the end of the travel and consists in essence of stochastic distance control errors $\Delta S_{FS}$. These are completely equalized until the end of the travel according to FIG. 4c by switching into the circuit the integrating amplifier 13.3 in the distance controller 13. Also included in this equalization are obviously other, for example due to inaccuracies not completely compensated, deterministic distance control errors $\Delta S_{FD}$. Only the massive reduction of the deterministic distance control error $\Delta S_{FD}$ by the compensation signal K makes it possible to apply successfully a PI controller in the distance control circuit, which equalizes to zero the remaining distance control errors $\Delta S_F$ in the short time available until the end of the travel with the only very small possible reset velocity. Higher reset velocities in the distance control circuit are not possible for reasons of stability, as the mechanical system reacts very sluggishly and with slight damping.

It is finally illustrated in FIG. 5 that a good command performance is also assured, with the device according to the invention, if the eleator has erroneously come to a stop outside of a floor of destination. This can occur in the case, if in spite of optimization of the cascade control KC and also after elimination of the distance control errors $\Delta S_{FD}$ and $\Delta S_{FS}$ caused by interferences, a residual distance control error $\Delta S_{FR}$ remains which brings the car to a stop shortly ahead or after a floor of destination. This means a change in the structure of the control path RC which then consists only of the armature current circuit of the hoisting motor locked by the static friction. In this case, an accelerated restart is required for a good command performance, so that the car can reach the floor of destination as soon as possible. However, there exists the difficulty that with the remaining small residual distance control error $\Delta S_{FR}$ and the small reset velocity of the distance controller 13, the motor torque will run-up only slowly according to the linearly assumed diagram 38; the motion occurs therefore only at the time $t_4$ after reaching the static friction $R_H$ and thus the floor is reached, according to the actual travel curve $S_{il}$, only at the time $t_5$, that is with a great time delay $t_5-t_1$.

Serving this purpose is the distance control error multiplier 35 with its controllable multiplication factor "m". The latter is set, for restart, prior to the beginning of the motion, to a value greater than one, so that on run-up the armature current and thus the motor torque starts out from a larger distance control error $\Delta S_{Fm}$ and at that proceeds even steeper, according to the linearly assumed diagram 39. Thereby, the static friction is already exceeded at the time $t_2$ and the motion initiated. For reasons of stability there takes place, at the beginning of the motion, a resetting of "m" to the value one by the tachometer generator 12, so that the car levels into the floor with a motor moment $M_M$ greater than $R_G$ according to the actual travel curve $S_{i2}$ and reaches the floor with a modest time delay $t_3-t_1$, at the time $t_3$.

It is obvious to the expert that the invention is not limited to the example of embodiment disclosed above. In particular, it is also suitable for door drives in the elevator technology. Furthermore, the realization of the method according to the invention is not tied to the utilization of analog circuits, it can just as well be realized in hybrid technology or by means of a microprocessor or another digital computer operated according to a program.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A method for the distance control of a positioning drive having a cascade structure wherein, through specifying an appropriate jerk input value and by a threefold integration over the time of the same, the control of a desired distance value takes place as well as the control of desired values of velocity and acceleration which are directly generated to subordinated velocity and armature current control circuits for forward correction, comprising the following steps:

a. defining a control distance which is the basis of a positioning drive as a standard control distance which can be influenced by interferences, and characterizing said standard control distance by a standardized set of values for the parameters of said control distance superimposed to which are parameter value changes caused by interferences;

b. adjusting a cascade control by fourfold forward correction to said standardized set of values for the parameters of said standard control distance including forward correcting a velocity controller by a specified desired velocity value, a current controller by a specified desired jerk value, and a control unit by said specified desired velocity value;

c. subdividing the interferences, which can have an effect on said standard control distance, into two classes, deterministic interferences which can be determined by a starting test and stochastic interferences which cannot be determined by a starting test;

d. quantitatively detecting said deterministic interferences by a starting test in a starting phase of every travel, forming a compensation signal therefrom which completely compensates a corresponding distance control error which occurs over a remaining travel distance, and inputting said compensation signal to said current controller;

e. inputting distance control errors caused by stochastic interferences, after a conclusion of the starting test, to an integrating amplifier which is connected to a distance controller for completely equalizing until the end of the travel all distance control errors still remaining after performing said steps a. through d.; and f. upon a restart after a stop outside a place of destination, temporarily increasing a corresponding residual one of said distance control errors.

2. The method according to claim 1 including performing said starting test during which, over a travel, self-compensating interferences are currently calculated and subtracted from an actual distance value to form a resultant distance control error and a time integral is formed from said resultant distance control error during a first jerk phase.

3. A device for the execution of the method according to claim 1 including a cascade control which receives as inputs desired values of acceleration and of jerk which are inputted as signals, through associated correction elements with scale factors, to a first summing point connected at an output to an input of a current comparator having an output connected to an input of a current controller, said cascade control receives a desired value of the velocity which is inputted as a signal through a correction unit with a scale factor to and input of a control unit connected to an output of said current controller, a measuring means for the compensation of the distance control errors caused by deterministic interferences is connected between an output of a distance comparator to an input of a function generator an output of which is connected to said first summing point, an output of said distance comparator is connected to an input of a distance controller having an output connected to an input of a velocity controller having an output connected to an input of said current comparator, an integrating amplifier for the equalization of the distance control errors caused by stochastic interferences is provided in said distance controller which, after the conclusion of said starting test, can be connected in parallel to a proportional amplifier by a switch both in said distance controller, a distance control error multiplier, with an adjustable multiplication factor, for a short term increase of the distance control error at restart after a stop is connected in series between said distance comparator and said distance controller and is connected to an operating control and to a means for generating an actual velocity signal for the control of said multiplication factor, whereby said multiplication factor is controlled prior to the beginning of the motion from a value of one to a value greater than one, and at the beginning of the motion from the value greater than one back to the value one.

4. The device according to claim 3 wherein said scale factors of corresponding ones of said correction elements are adjustable.

5. The device according to claim 3 wherein said measuring means is an integrator which integrates the distance control error during a first jerk phase.

6. The device according to claim 3 wherein said function generator generates a compensation signal which is formed with a ramp shaped rise followed by a constant magnitude portion.

7. The device according to claim 6 wherein said constant magnitude portion has an amplitude which is a function of an error signal formed in said measuring means and said amplitude is reached by said ramp shaped rise with one of a variable slope with a constant rise time and a variable rise time with a constant slope.

8. The device according to claim 3 wherein for a calculation of a self compensating distance control error caused by the dynamic elongation of a cable supporting an elevator car to be positioned, the position of the car is represented by an actual distance value which is inputted to a difference amplifier connected to said distance comparator.

9. A method for the distance control of a positioning drive in an elevator system having an electric motor for driving an elevator car in an elevator shaft to predetermined destinations comprising the steps of:

a. defining a standard control distance, which can be influenced by interferences, by a standardized set of values for the parameters of an elevator system to be controlled;

b. providing a cascade control including connected in series, a distance controller, a velocity controller, a current controller, and a control unit for generating armature current to an electric motor in the elevator system to be controlled;

c. adjusting said cascade control by fourfold forward correction to said standardized set of values including inputting a desired velocity command signal to said velocity controller and to said control unit and inputting a desired jerk command signal to said current controller;

d. subdividing said interferences into deterministic interferences which can be determined by a starting test and stochastic interference which cannot be determined by a starting test;

e. detecting said deterministic interferences by a starting test in a starting phase of every travel of an elevator car in the elevator system, forming a compensation signal from said deterministic interferences, and inputting said compensation signal to said current controller;

f. after a conclusion of said starting test, inputting distance control errors through an integrating amplifier to said distance controller for completely equalizing all distance control errors remaining after performing said steps a. through e.; and g. upon a restart after a stop of the elevator car outside of a place of destination, temporarily increasing a corresponding one of said distance control errors.

10. The method according to claim 9 including calculating self-compensating interferences during said starting test, subtracting said self-compensating interferences from an actual distance value to obtain a distance control error value, integrating said distance control error value during a first jerk phase to form a time integral value, and inputting said time integral value to said velocity controller.

11. An apparatus for controlling the position of an elevator car supported by a cable and driven by an electric motor comprising:

a distance controller having an input and having an output connected to an input of a velocity controller, said velocity controller having an output connected to an input of a current controller, said current controller having an output connected to an input of a control unit, said control unit having an output for supplying current to an electric motor in an elevator system;

a first summing point connected to a source of a desired distance command signal and a source of an actual distance signal and having an output connected to said distance controller input;

a second summing point connected to a source of a desired velocity command signal, a source of an actual velocity signal and to said output of said distance controller and having an output connected to said velocity controller input;

a third summing point connected to a source of a desired jerk command signal and a source of a desired acceleration command signal and having an output;

a fourth summing point connected to said third summing point output, a source of an actual current signal and to said velocity controller output and having an output connected to said current controller input;

a fifth summing point connected to said source of a desired velocity command signal and to said current controller output and having an output connected to said control unit input;

a measuring means having an input connected to said first summing point output and responsive to deterministic interferences for generating a measurement value error signal at an output;

a function generator having an input connected to said measuring means output for generating a compensation signal at an output connected to said third summing point; and a series connected integrating amplifier and switch connected in parallel with a proportional amplifier in said distance controller and an operating control for closing said switch for a short time at a restart after a stop of the elevator car.

12. The apparatus according to claim 11 wherein a first velocity correction element is connected between said desired velocity command signal source and said second summing point and a second velocity correction element is connected between said desired velocity command signal source and said source and said fifth summing point.

13. The apparatus according to claim 12 wherein a jerk correction element is connected between said desired jerk command signal source and said third summing point and an acceleration correction element is connected between said desired acceleration command signal source and said third summing point.

14. The apparatus according to claim 13 wherein said correction elements each have a different adjustable scale factor.

15. The apparatus according to claim 11 including a distance control error multiplier with an adjustable multiplication factor connected between said first summing point output and said distance controller input and connected to said operating control and to said source of an actual velocity signal whereby said multiplication factor is controlled prior to the beginning of the motion from a value of one to a value greater than one, and at the beginning of the motion from the value greater than one back to the value one.

16. The apparatus according to claim 11 wherein said measuring means is an integrator which integrates a distance control error generated at said first summing point output during a first jerk phase.

17. The apparatus according to claim 11 including a computing unit for generating self compensating distance control errors at an output connected to an input of a difference amplifier, said difference amplifier having another input connected to said actual distance signal source, and an output connected to an input of said first summing point.

18. The apparatus according to claim 11 wherein said first summing point is a distance comparator, said second summing point is a velocity comparator, and said third summing point is a current comparator.

* * * * *